United States Patent [19]

Kaneko

[11] 3,961,669

[45] June 8, 1976

[54] AUTOMOBILE FIRE FIGHTING APPARATUS

[75] Inventor: Mikio Kaneko, Toyoda, Japan

[73] Assignee: Toyota Jidosha Kogyo Kabushiki Kaisha, Japan

[22] Filed: Oct. 9, 1974

[21] Appl. No.: 513,235

[30] Foreign Application Priority Data

Dec. 6, 1973 Japan ..... 48-136627

[52] U.S. Cl. ..... 169/62; 169/74; 222/80

[51] Int. Cl.[2] ..... A62C 35/12; A62C 13/40

[58] Field of Search ..... 169/62, 26, 83, 9, 58, 169/74, 27; 222/80; 239/309; 220/89 A

[56] References Cited

UNITED STATES PATENTS

| | | | |
|---|---|---|---|
| 1,058,937 | 4/1913 | Barron | 169/83 |
| 1,062,463 | 5/1913 | Harwood | 169/83 X |
| 1,337,130 | 4/1920 | Haines | 169/83 |
| 2,800,966 | 7/1957 | McKissick | 169/62 X |
| 3,595,429 | 7/1971 | Kohen | 220/203 |
| 3,815,779 | 6/1974 | Ludwig et al. | 220/89 A |

FOREIGN PATENTS OR APPLICATIONS

| | | | |
|---|---|---|---|
| 216,792 | 6/1924 | United Kingdom | 169/62 |

*Primary Examiner*—Evon C. Blunk
*Assistant Examiner*—Michael Mar
*Attorney, Agent, or Firm*—Stevens, Davis, Miller & Mosher

[57] ABSTRACT

A fire fighting apparatus for installation in an automobile, essentially comprising an outer container containing a fire extinguishing composition, an inner container encased in the outer container and supported in a fixed position relative to the outer container, the inner container containing a high pressure gas, and a plunger slidably supported by the outer container in a destructively engageable relationship with the inner container. The outer container includes an outlet defining a nozzle which is normally closed by a plug made of a collapsible material. The inner container is at least partially made of a fragile material, and the plunger is destructively engageable with the fragile material. An impact generated by collision of the automobile brings the plunger into destructive engagement with the inner container, so that the high pressure gas flows out into the outer container and raises the pressure of the composition therein. The composition collapses the plug and spouts out through the nozzle.

10 Claims, 4 Drawing Figures

AUTOMOBILE FIRE FIGHTING APPARATUS

BACKGROUND OF THE INVENTION

This invention relates to an apparatus to be installed on an automobile for preventing or extinguishing a fire thereon, and more particularly to such apparatus automatically operable to prevent or extinguish a fire which may break out in an automobile upon collision thereof with another automobile or a nearby building or other structure, or when the automobile has otherwise received a large impact thereon.

A large impact given to an automobile, whether by collision or otherwise, often causes damage to the fuel tank, fuel pipe or fuel pipe fitting thereof with a resultant leakage of vaporized gasoline therefrom. This vaporized gasoline is ignited and starts a fire in the automobile upon contacting an engine portion at an elevated temperature. Such a fire is very dangerous as it does not only burn the automobile, but may also often injure or even kill a person or persons in the automobile or cause damage to a nearby house or other structure. A fire is also started by ignition of such vaporized fuel due to the frictional heat generated upon collision. Sparks produced by short-circuiting of electrical equipment on an automobile also give rise to a fire. The inherent danger of a fire on an automobile is on the increase as the automobile is equipped with an increasing number of different electrical parts or devices, and also as it is equipped with an exhaust gas purifying system for operation at a high temperature.

Despite the obvious danger of a fire on an automobile, however, few countermeasures have been proposed with practical success in the past. That is apparently because it has been difficult to provide a fire fighting apparatus compactly designed for installation in a limited interior space available on an automobile and is automatically brought into sure and effective operation immediately on the occasion of collision or any other impact generating accident.

SUMMARY OF THE INVENTION

It is an object of this invention to provide a fire fighting apparatus which is installed on an automobile and is automatically operable immediately on the occasion of collision or any other impact generating accident to surely and effectively prevent or extinguish a fire which may break out in the automobile upon such collision or accident.

It is another object of this invention to provide a fire fighting apparatus which is easy to install removably in an automobile portion in which a fire may often start upon collision of the automobile or occurrence of any other impact generating accident.

It is a further object of this invention to provide a fire fighting apparatus for an automobile which is compactly designed and yet owns a great fire fighting capability.

It is a still further object of this invention to provide a fire fighting apparatus for an automobile which is simple in construction and can be manufactured easily and inexpensively.

Other objects and advantages of this invention will become apparent from the following detailed description and the accompanying drawings.

DETAILED DESCRIPTION

Figure 1:
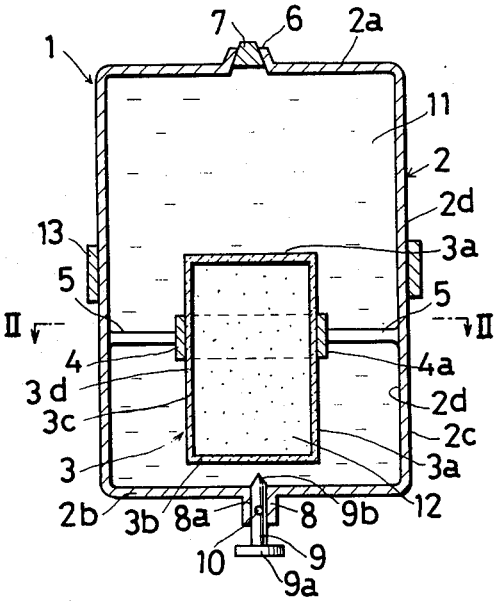
FIG. 1 is a transverse sectional view of a preferred embodiment of this invention.
Figure 2:
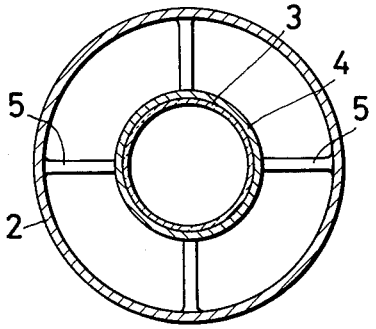
FIG. 2 is a sectional view taken along the line II—II of FIG. 1.

Referring to FIGS. 1 and 2 of the drawings, a fire fighting apparatus 1 according to a preferred embodiment of this invention comprises an outer container 2 and an inner container 3 housed in the outer container 2. The outer container 2 comprises a cylindrical portion 2*c* which is closed at the opposite ends thereof by a pair of end plates 2*a* and 2*b*. The outer container 2 may, as a whole, be made of steel or any other appropriate metal. The inner container 3 comprises a cylindrical portion 3*c* closed at the opposite ends thereof by a pair of end plates 3*a* and 3*b*. The inner container 3 may be made of glass or any other appropriate fragile material as a whole. Alternatively, only one end plate 3*b* or a portion thereof may be made of a fragile material for the reason to be later explained, while the remaining part of the inner container 3 is made of a durable material. It has been found practically preferable to employ a foil of a metal, such as aluminum, only in the central portion of the end plate 3*b*, while the remaining part of the inner container 3 is fabricated from a thicker sheet of the metal. In the event the inner container 3 is made of a plurality of different materials or with different thicknesses, joining may be accomplished by any appropriate known method, wherever necessary.

The inner container 3 is supported by a holding ring 4 which encircles the inner container 3 approximately in the middle of the cylindrical portion 3*c*. The holding ring 4 is made of a sheet of steel or any other appropriate metal having a width suitable for holding the inner container 3 in position, while the inner surface of the ring 4 closely contacts the outer surface 3*d* of the cylindrical portion 3*c*. A plurality of supporting bars 5 extend between the outer container 2 and the holding ring 4 and may be made of metal. The supporting bars 5 are provided radially relative to the outer container 2 in an equally spaced relationship, and one end of each bar 5 is joined by welding or otherwise to the inner surface 2*d* of the cylindrical portion 2*c* of the outer container 2, while the other end of each bar 5 is joined in a like manner to the outer surface 4*a* of the holding ring 4. The supporting bars 5 are all of the same length, so that the inner container 3 is supported in the outer container 2 in a coaxial relationship with the outer container 2 as shown in FIG. 2. One end plate 2*a* of the outer container 2 is formed with a relatively small opening in the center thereof, and the peripheral edge of this opening is bent outwardly to define a nozzle 6 at the outermost tapered end thereof. An outwardly tapered plug 7 is fitted in the nozzle defining portion of the end plate 2*a* and has a peripheral surface which is complementary to the inner surface of the nozzle defining portion, so that the plug 7 keeps the nozzle 6 closed under the normal situation. The plug 7 is made of rubber or any other suitable material that will allow the plug 7 to be easily broken to open the nozzle 6 when the internal pressure of the outer container 2 exceeds a predetermined level as will later be described in detail.

The opposite end plate 2*b* of the outer container 2 is formed in the center thereof with a similar opening which defines an outwardly extending tubular projection 8 in a coaxial relationship with the inner container 3. A plunger 9 is received in the bore 8*a* of the tubular projection 8. The plunger 9 may be made of metal or any other appropriate rigid material and includes a relatively elongate stem portion 9*c* having a circular cross section complementary to the bore 8*a*. The stem portion 9*c* includes a pointed inner end 9*b* facing the end plate 3*b* of the inner container 3 and projecting into the outer container 2. The outer end of the stem portion 9*c* extends outwardly from the outer end 14 of the tubular projection 8 and terminates in a flange or head portion 9*a* having a large diameter relative to the stem portion 9*c*. The tubular projection 8 of the outer container 2 has a pair of diametrically oppositely formed holes having an equal small diameter approximately in the middle thereof. The stem portion 9*c* of the plunger 9 is formed approximately in the middle thereof with a diametrically extending hole of a diameter which is substantially equal to that of the holes provided in the tubular projection 8. The hole in the stem portion 9*c* is aligned with the holes in the tubular projection 8. A shear pin 10 extends through the holes provided in the tubular projection 8 and the stem portion 9*c*. Under the normal situation, the shear pin 10 maintains the plunger 9 in its retracted position as shown in FIG. 1 in which the pointed end 9*b* is spaced apart from the end wall 3*b* of the inner container 3. The flange 9*a* of the plunger 9 is spaced from the outer end 14 of the tubular projection 8 to such an extent that the pointed end 9*b* of the plunger 9 can pierce the end plate 3*b* of the inner container 3 upon sliding displacement of the plunger 9 into the outer container 2 when an impact resulting from collision of the automobile or a like cause is applied onto the flange 9*a* and the shear pin 10 is broken.

The outer container 2 contains a foamable fire extinguishing composition alternatively, either in the form of powder or liquid. If the composition 11 is liquid, an appropriate seal is provided between the nozzle 6 and the plug 7 and between the tubular projection 8 and the plunger 9 in any known manner to prevent the composition 11 from leaking out of the outer container 2. The composition 11 may be selected from any fire extinguishing chemical readily available on the market if it can extinguish a fire caused by combustion of gasoline. For example, the composition 11 may be prepared from sodium bicarbonate if a powder form is preferred, or alterantively, carbon tetrachloride may be used if a liquid form is preferred. The inner container 3 contains a high pressure gas, such as carbon dioxide and nitrogen. The inner container 3 is wholly or partially made of a fragile material as mentioned before, but is required to withstand the high pressure of the gas contained therein and remain a totally closed structure until the end plate 3*b* is broken by the plunger 9. It is thus preferable to make the central portion of the end plate 3*b* of an aluminum foil to permit the plunger 9 to easily break through the end plate 3*b*, while the remaining part of the inner container 3 is made of a thicker material.

Figure 3:
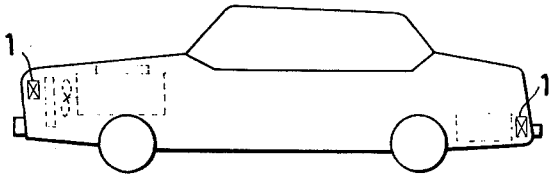
FIG. 3 is a diagrammatic side elevational view of an automobile illustrating one apparatus of the invention installed in the engine hood and another installed near the fuel tank.
Figure 4:
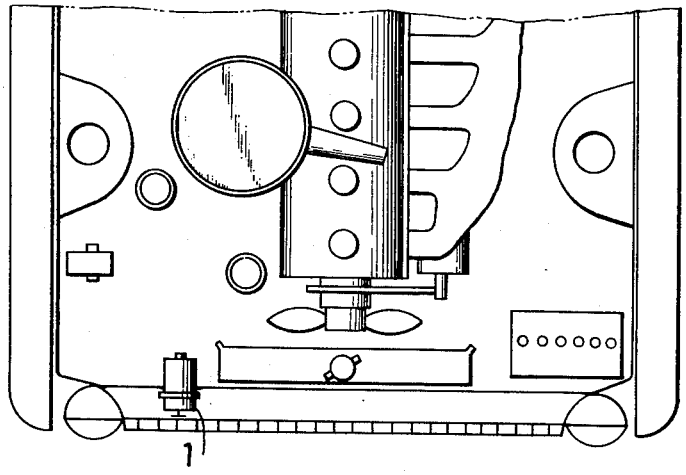
FIG. 4 is an enlarged view in plan of the apparatus installed in the engine hood.

The outer container 2 is encircled by an annular band 13 closely contacting the outer surface of the outer container 2 approximately in the middle of the cylindrical portion 2*c*. The band 13 may be made of metal and provides means for removably mounting the apparatus 1 in any desired location on the automobile. Mounting of the apparatus 1 by the band 13 may be accomplished in any known manner and no further explanation will be required in connection therewith. It is, however, essential to install the apparatus in a location or locations where a fire is more likely to start than in any other locations upon leakage of fuel as the result of collision or application of any large impact against the automobile. It is preferable to install one unit of the apparatus 1 in the engine hood and another unit near the fuel tank as shown in FIGS. 3 and 4. It is also necessary to position the apparatus 1 in a posture which permits quick response of the plunger 9 upon collision of the automobile. More particularly, the flange portion 9*a* of the plunger 9 must be directed in a direction in which an impact applied to the automobile upon collision thereof or otherwise is easily transmitted to the flange portion 9*a* by deformation of a portion of the automobile body and contact thereof with the flange portion 9*a* to cause displacement of the plunger 9 into piercing contact with the end plate 3*b* of the inner container 3.

Upon collision of the automobile, the impact applied to the automobile body acts upon the flange portion 9*a* of the plunger 9. The plunger 9 breaks the shear pin 10 and plunges into the outer container 2. The pointed end 9*b* of the plunger 9 strikes against the adjacent end plate 3*b* of the inner container 3 and breaks therethrough. The gas gets out of the inner container 3 into the outer container 2 and the composition 11 in the outer container 2 is foamed. The foamed composition 11 breaks the plug 7 and is discharged through the nozzle 6 to prevent a fire or extinguish a fire if any has already started.

Although only one plunger 9 has been described and shown, it is possible to provide a plurality of differently directed plungers so that any one of the plungers may be actuated in whichever direction an impact is applied to the automobile and transmitted to the apparatus 1. Likewise, it is possible to provide the outer container 2 with a plurality of nozzles for discharging the composition 11 in a plurality of different directions. In the event a plurality of plungers are provided, it will be understood that the inner container 3 must be made of a fragile material in its entirety. It will also be easy for any person skilled in the art to operationally associate the plunger 9 with an accelerometer which measures the acceleration of the automobile upon its collision and causes the plunger to break through the adjacent wall of the inner container 3 when the acceleration has exceeded a predetermined level.

While the invention has been described with reference to a preferred embodiment thereof, it will be understood that modifications or variations may be easily made by those skilled in the art without departing from the scope of the invention which is defined by the appended claims.

What is claimed is:

1. A fire fighting apparatus for installation on an automobile body, said apparatus being adapted for automatic operation upon application of a colliding impact onto said automobile body, said apparatus comprising:

an outer container made of a rigid material and comprising a cylindrical body closed by a pair of end walls at the opposite ends thereof, said outer container containing a fire fighting composition;

a first opening formed in one of said end walls of said outer container in a substantially coaxial relationship with said cylindrical body, said first opening defining an outwardly extending hollow projecting having a tapered construction which terminates in a nozzle for discharging said composition from said outer container;

a plug in said hollow projection, said plug being tapered complementarily to said hollow projection and normally keeping said nozzle closed, said plug being made of a material which is easily collapsible when subjected to an elevated pressure;

a second opening formed in the other of said end walls of said outer container in a substantially coaxial relationship with said cylindrical body, and defining an outwardly extending tubular projection;

an inner container containing a high pressure gas therein and encased in said outer container in a substantially coaxial relationship with said outer container, said inner container comprising a cylindrical body closed by a pair of end walls at the opposite ends thereof, said cylindrical body of said inner container being considerably smaller in diameter and length than said cylindrical body of said outer container, one of said end walls of said inner container being made of a fragile material at least in the central portion thereof and located close to said other end wall of said outer container;

an elongate plunger slidably received in said tubular projection, one end of said plunger being pointed and located in a destructively engageable relationship with said one end wall of said inner container, the other end of said plunger being located outside of said tubular projection and terminating in an enlarged head, said head being spaced apart from said tubular projection by a distance which permits said one end to plunge into destructive engagement with said one end wall of said inner container upon sliding movement of said plunger, a hoop encircling said cylindrical body of said inner container for holding said inner container in a fixed position relative to said outer container;

a plurality of equally spaced, radially extending supporting bars each joined to said hoop at one end and said cylindrical body of said outer container at the other end, said bars cooperating with said hoop in supporting said inner container on said outer container; and another hoop encircling said cylindrical body of said outer container for attaching said apparatus to a convenient portion of said automobile body.

2. A fire fighting apparatus for installation on an automobile body, said apparatus being adapted for automatic operation upon application of a colliding impact onto said automobile body, said apparatus comprising:

a first normally closed means containing a fire fighting composition therein and having at least one outlet opening for said composition, said first normally closed means comprising a cylindrical body having a pair of end walls closing said cylindrical body at the opposite ends thereof, a hollow projection extending downwardly from said outlet opening and defining a nozzle means for discharging said composition upon said pressure elevation thereof and a plug means normally closing said nozzle means but capable of collapsing upon said pressure elevation to open said nozzle;

a second normally closed means encased in and supported by said first normally closed means and containing a high pressure gas therein, said second normally closed means being at least partially made of a fragile material;

at least one striker means slidably supported in hollow supporting means projecting outwardly from said first normally closed means and located in a destructively engageable relationship with said second normally closed means, said striker means closing said hollow supporting means to prevent said composition from leaking out therethrough and being adapted, upon said colliding impact application, to strike against and destroy said fragile material to release said high pressure gas from said second normally closed means to cause said pressure elevation in said first normally closed means; and at least one annular means encircling said cylindrical body for attaching said apparatus to a convenient portion of said automobile body.

3. The apparatus as defined in claim 2 wherein said plug means is made of rubber.

4. The apparatus as defined in claim 2 wherein said second normally closed means is at least partially made with a smaller wall thickness than in the remaining portion thereof.

5. A fire fighting apparatus for installation on an automobile body, said apparatus being adapted for automatic operation upon application of a colliding impact onto said automobile body, said apparatus comprising;

a first normally closed means containing a fire fighting composition therein and having at least one outlet opening for said composition, said first normally closed means comprising a cylindrical body having a pair of end walls closing said cylindrical body at the opposite ends thereof, a tapered hollow projection extending outwardly from said outlet opening and defining a nozzle means for discharging said composition upon said pressure elevation thereof and a plug means normally closing said nozzle means but capable of collapsing upon said pressure elevation to open said nozzle, said plug means having a tapered shape complementary to that of said hollow projection;

a second normally closed means encased in and supported by said first normally closed means and containing a high pressure gas therein, said second normally closed means being at least partially made of a fragile material; and at least one striker means slidably supported in hollow supporting means projecting outwardly from said first normally closed means and located in a destructively engageable relationship with said second normally closed means, said striker means closing said hollow supporting means to prevent said composition from leaking out therethrough and being adapted, upon said colliding impact application, to strike against and destroy said fragile material to release said high pressure gas from said second normally closed means to cause said pressure elevation in said first normally closed means.

6. A fire fighting apparatus for installation on an automobile body, said apparatus being adapted for automatic operation upon application of a colliding impact onto said automobile body, said apparatus comprising:

a first normally closed means containing a fire fighting composition therein and having at least one outlet opening for said composition, said first normally closed means comprising a cylindrical body having a pair of end walls closing said cylindrical body at the opposite ends thereof, a hollow projection formed in one of said end walls and extending outwardly from said outlet opening and defining a nozzle means for discharging said composition upon said pressure elevation thereof and a plug means normally closing said nozzle means but capable of collapsing upon said pressure elevation to open said nozzle;

a second normally closed means encased in and supported by said first normally closed means and containing a high pressure gas therein, said second normally closed means being at least partially made of a fragile material;

hollow supporting means formed in the other of said end walls and comprising a relatively small circular opening formed in said other end wall and a correspondingly sized tubular projection extending outwardly from said circular opening;

at least one striker means slidably received in said tubular projection and closing said circular opening to prevent said composition from leaking out through said hollow supporting means, said striker means comprising an elongated member having an outer surface complementary to the inner surface of said circular opening and said tubular projection, one end of said elongated member being located inwardly of said other end wall in a destructively engageable relationship with said second normally closed means, the opposite end of said elongated member extending outwardly from said tubular projection and terminating in an enlarged head, said enlarged head being spaced apart from said tubular projection by a distance which permits said one end to strike against and destroy said fragile material to to release said high pressure gas from said second normally closed means to cause said pressure elevation in said first normally closed means upon said colliding impact application; and a shear pin extending diametrically through said tubular projection and said elongated member to keep said one end of said elongated member from destructively engaging said second normally closed means until said colliding impact application.

7. The apparatus as defined in claim 6 wherein said one end of said elongate member is pointed.

8. A fire fighting apparatus for installation on an automobile body, said apparatus being adapted for automatic operation upon application of a colliding impact onto said automobile body, said apparatus comprising:

a first normally closed means containing a fire fighting composition therein and having at least one outlet opening for said composition, said first normally closed means comprising a first cylindrical body having a pair of ends walls closing said cylindrical body at the opposite ends thereof, a hollow projection formed in one of said end walls and extending outwardly from said outlet opening and defining a nozzle means for discharging said composition upon said pressure elevation thereof and a plug means normally closing said nozzle means but capable of collapsing upon said pressure elevation to open said nozzle;

a second normally closed means encased in and supported by said first normally closed means and containing a high pressure gas threin, said second normally closed means comprising a second cylindrical body and a pair of end walls closing said second cylindrical body at the opposite ends thereof, wherein said second normally closed means is coaxial with said first normally closed means and is positioned closer to said other end wall of said first normally closed means than to said one end wall thereof, and wherein only the central portion of one of said second cylindrical body end walls is made of a fragile material; and at least one striker means slidably supported in hollow supporting means formed in the other of said end walls and projecting outwardly from said first normally closed means and located in a destructively engageable relationship with said second normally closed means, said striker means closing said hollow supporting means to prevent said composition from leaking out therethrough and being adapted, upon said colliding impact application, to strike against and destroy said fragile material to release said high pressure gas from said second normally closed means to cause said pressure elevation in said first normally closed means, and said striker means is located close to one of said end walls of said normally closed means and coaxial with said one end wall of said second normally closed means.

9. The apparatus as defined in claim 8 wherein said central portion is made of an aluminum foil.

10. The apparatus as defined in claim 8 further including:

at least one annular means encircling said cylindrical body and holding said second normally closed means in a fixed position relative to said first normally closed means; and a plurality of substantially equally spaced, radially extending elongate members each joined to said annular means at one end and said first normally closed means at the other end, whereby said second normally closed means is supported by said first normally closed means.

* * * * *

UNITED STATES PATENT OFFICE

CERTIFICATE OF CORRECTION

PATENT NO. : 3,961,669

DATED : June 8, 1976

INVENTOR(S) : KANEKO

It is certified that error appears in the above-identified patent and that said Letters Patent are hereby corrected as shown below:

Col. 3, line 56, "alterantively" should read --alternatively--.

Col. 7, line 46, "to to" should read --to--.

Col. 8, line 7, "ends walls" should read --end walls--;

Col. 8, line 18, "threin" should read -- therein --.

Signed and Sealed this

Seventh Day of September 1976

[SEAL]

*Attest:*

RUTH C. MASON
*Attesting Officer*

C. MARSHALL DANN
*Commissioner of Patents and Trademarks*